United States Patent [19]

Goeller

[11] Patent Number: 4,834,118

[45] Date of Patent: May 30, 1989

[54] HEATABLE FLEXIBLE HAIR CURLERS

[75] Inventor: Loretta D. Goeller, Rowayton, Conn.

[73] Assignee: Clairol Incorporated, New York, N.Y.

[21] Appl. No.: 884,880

[22] Filed: Jul. 10, 1986

Related U.S. Application Data

[63] Continuation of Ser. No. 671,157, Nov. 14, 1984, abandoned.

[51] Int. Cl.[4] ..... A45D 7/02

[52] U.S. Cl. ..... 132/211; 132/246

[58] Field of Search ..... 132/43 R, 43 A, 36.2 B, 132/39, 40, 41 R, 41 A, 41 B, 42 R, 42 A, 44, 211, 246

[56] References Cited

U.S. PATENT DOCUMENTS

| | | | |
|---|---|---|---|
| Re. 15,363 | 5/1922 | McClaire | 132/43 R |
| 2,061,817 | 11/1936 | Van Cleef | 132/43 R |
| 2,074,816 | 3/1937 | Trotter | 132/43 R |
| 2,542,601 | 2/1951 | Van Cleef | 132/43 R |
| 2,627,275 | 2/1953 | Kiviluoma | 132/43 R |
| 2,838,054 | 6/1958 | Fischer | 132/43 R |
| 3,538,925 | 11/1970 | Reiner | 132/39 |
| 4,022,225 | 5/1977 | Kauffman | 132/269 |
| 4,041,961 | 8/1977 | Shaler et al. | 132/40 |
| 4,236,540 | 12/1980 | Takagi et al. | 132/233 |
| 4,431,012 | 2/1984 | Albertoni | 132/233 |
| 4,572,221 | 2/1986 | Barradas | 132/33 R |

FOREIGN PATENT DOCUMENTS

| | | | |
|---|---|---|---|
| 0049307 | 4/1982 | European Pat. Off. | 132/39 |
| 2111382 | 7/1983 | United Kingdom | 132/43 R |
| 2116032 | 9/1983 | United Kingdom | 132/43 R |

*Primary Examiner*—John J. Wilson

*Attorney, Agent, or Firm*—Gene Warzecha

[57] ABSTRACT

An elongated flexible hair curler having a central core molded within a pliable viscoelastic polymer heat-retaining body. The hair curler comprises a generally elongated structure having rounded ends and is capable of being bent into a plurality of positions including being bent through an angle of substantially 180° back upon itself in order to retain a hair tress wound thereon curler without the aid of hair clips. The heat retaining body is capable of being heated by an external means to a predetermined temperature and able to retain the heat for a predetermined time in order to facilitate the setting of curls in hair.

2 Claims, 2 Drawing Sheets

HEATABLE FLEXIBLE HAIR CURLERS

This is a continuing application of application Ser. No. 671,157 filed Nov. 14, 1984, now abandoned.

BACKGROUND OF THE INVENTION

1. Field of the Invention

This invention relates to hair curlers for having hair tresses wound thereon in order to impart a curl to the hair. In particular, this invention relates to elongated flexible hair curlers.

2. Description of the Prior Art

Elongated flexible hair curlers have been known for quite some time. Such curlers generally comprise cylindrical bodies made of resilient material such as foam or sponge rubber and have a wire or soft metal core embedded within the body along the axis of the curler. An elongated flexible curler is much longer than an inflexible curler in order to enable it to be bent over on itself to retain a hair tress wound thereon. This avoids the necessity of a clip to hold the hair as is required with inflexible curlers. Elongated flexible curlers also may be bent in a variety of positions after hair is wound thereon and thus may impart a variety of waves to the hair. The metal core enables the curler to be bent and to retain the position it is placed in until it is bent into another position.

Examples of one type of elongated flexible curler are shown in U.S. Pat. Nos. 1,619,743 and Re. 15,363 showing a wire core within a cylindrical pliable rubber covering encased in a fibrous cover. U.S. Pat. Nos. 2,061,817 and 2,542,601 show flexible hair curlers having a central metal core and a compressible sponge rubber, solid natural or synthetic rubber body molded around the core. More recent prior art is shown in U.K. patent application No. GB 2,111,382 disclosing an elongated curler having a central wire core surrounded by a sleeve and polyethylene foam jacket and having end caps covering the wire ends. U.K. patent application No. GB 2,067,898 shows a curler having a "pipe cleaner" core element extending beyond the curler body in order to enable the ends to be bent back over the body.

None of the aforementioned prior art elongated flexible curlers is identified as being suitable for being heated and for retaining sufficient heat for a sufficient time period to facilitate setting a curl in the hair. Foam rubber curlers are unsuitable for heat retention because they have an open-celled structure with many air pockets which do not retain heat well. While some relatively solid material is required to enhance heat retention, solid rubber curlers are unsuitable because they are relatively hard to the touch, inflexible, and continued exposure to heat would tend to deteriorate the rubber. Natural and synthetic rubber like that used in the curler referred to in U.S. Pat. No. 2,542,601 generally has durometer reading on the order of 30–100 Shore A. This amount of hardness makes the material not sufficiently flexible or elastic for satisfactory curler applications and causes the body material to tend to straighten the wire. Because of the hardness of the body material the core wire must be relatively large to overcome the inflexibility of the rubber. Also, the rubber curler disclosed in U.S. Pat. No. 2,542,601 does not address the issue of flammability of the body material because that curler is not designed to be heated. In a heatable curler nonflammability is important. There is no suggestion in this patent of what material may be used which has all of the desirable characteristics. Furthermore, there is no suggestion in the aforementioned prior art patents as to how to overcome the well-known heat-aging propensity of rubber-based compounds.

U.S. Pat. No. 2,074,816 shows an elongated flexible hair curler having an absorbent casing filled with a material such as calcium oxide which when moistened generates heat. The curler disclosed in this patent is incapable of generating heat in use with dry hair. Additionally, the use of a discrete chemical composition within the curler requires extra effort and expense to insure integrity of the calcium oxide component throughout the life of the curler.

It is an object of this invention to provide an elongated flexible curler capable of being heated and retaining sufficient heat for a sufficient time to facilitate setting a curl in hair wound on the curler.

It is a further object of this invention to provide an elongated flexible curler capable of being heated dry and of retaining heat for a sufficient time in use with either dry or dampened hair to facilitate setting a curl in the hair.

It is yet another object of this invention to provide a heatable elongated flexible curler capable of repeated and continued exposure to high hair curling temperatures without significant deterioration, capable of being bent substantially 180° and retaining such bent position, and having a durometer reading of approximately 30–70 Shore 00.

SUMMARY OF THE INVENTION

These and other objects of this invention are achieved by improvements in a flexible hair curler having a central elongated core capable of being bent into a plurality of positions and of retaining any such position, the improvement comprising a viscoelastic polymer body molded about said core and the ends thereof, said body being heatable by external means to a predetermined temperature and able to retain heat for a predetermined time. The product of the invention may, because the viscoelastic polymer is sufficiently supple, be bent into an infinite number of positions with the relative stiffness of the wire holding each position as desired.

In the preferred embodiment the central core is a wire having a predetermined size on the order 16 gauge the ends of which are bent into loops in order to assist in the retention of the wire within the molded body and in order to inhibit movement of the wire within the body to prevent the wire from penetrating the ends thereof.

In alternate embodiments, this invention may also comprise a structure having a central elongated core surrounded by an open-called foam impregnated with a predetermined gel having good heat retention qualities and encased within a flexible tube in order to preserve integrity of the impregnated foam/gel composition.

DESCRIPTION OF THE PREFERRED EMBODIMENT

Figure 1:
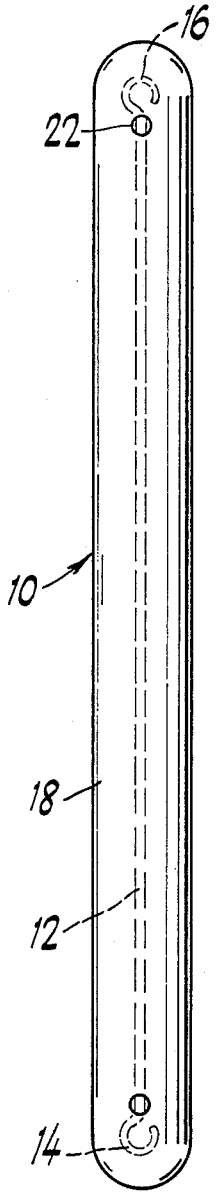
FIG. 1 shows a plan view of a flexible hair curler constructed in accordance with the principles of this invention.

Referring now to FIG. 1 there is shown a plan view of the preferred embodiment of the invention showing a flexible hair curler 10 in an elongated unbent position. By reference to FIG. 4 it will be understood that, in operation, after a hair tress is wound upon the curler it be bent back upon itself or in a variety of positions in order to retain the hair tress thereon without the aid of clips.

Figure 2:
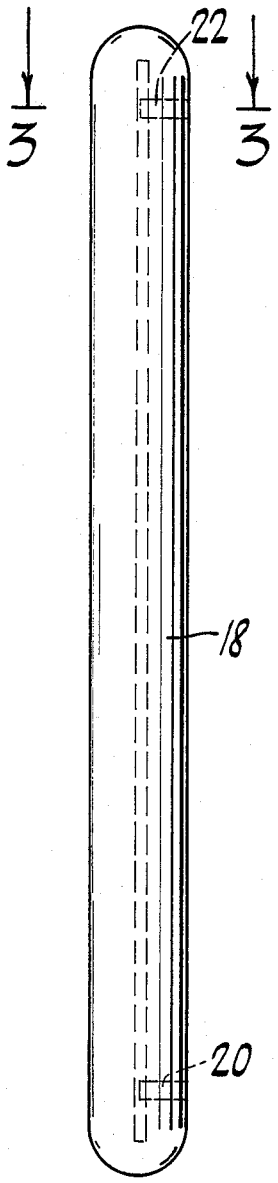
FIG. 2 shows a side elevational view of FIG. 1.
Figure 3:
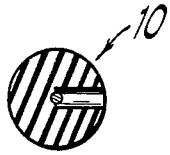
FIG. 3 shows a cross-sectional view of FIG. 2 taken along the line 3—3.

Curler 10 includes a central wire core 12 (shown in phantom in FIGS. 1 and 2) the ends of which are bent into loops 14 and 16. Wire 12 is embedded within body 18 and may be either bare or coated with vinyl or the like. Curler 10 is manufactured in a mold (not shown) by having wire 12 retained upon core pins (not shown) while body 18 is injected or cast into the mold. After body 18 has set, curler 10 is removed from the mold. The removal of the core pins leaves apertures 20 and 22 which may remain or may be filled with a suitable plug material. The core pins have a semi-circular recess (the complement of which is best seen in FIG. 3) within which wire 12 is held while the mold sets.

It will be understood that the body 18 must be made of a pliable heat-retaining material able to be heated by an external means to a predetermined temperature suitable for hair setting and able to retain the heat for a predetermined time sufficient to set a curl in the hair wound upon the curler 10. It has been found that such a material should be able to repeatedly withstand high temperatures of approximately 100° centigrade for relatively long periods of time and must be able to withstand repeated exposure to such temperatures without significant deterioration. Such material should also be relatively nonflammable and nontoxic in order to be suitable for consumer use. Additionally, the material should have a nonsticky surface and be sufficiently flexible and pliable in order to enable it to be bent into a variety of positions including being bent back upon itself to retain the hair wound thereupon. The material should be a relatively solid material rather than a foam structure in order to have the foregoing beneficial characteristics and also have a high heat capacity and be able to retain the heat for a significant period of time while conducting it to the hair wound upon the curler. Rubber alone, which was disclosed in the prior art, is not soft enough or flexible enough to achieve these functions. Even if it is softened with plasticizers the combination remains unsuitable for consumer use because the flammability increases and the plasticizers are extremely corrosive to materials with which the roller may come in contact (for example, varnish on wood surfaces). The material must have all of the aforementioned characteristics and in addition should feel soft to the user to enhance comfort and facilitate handling.

It has been found that certain polyurethane based compounds possess all of the aforementioned desirable properties and are suitable for use in flexible hair curlers. Because of their low durometer readings and viscoelastic properties, these materials enable use of smaller diameter wire than prior art rubber curlers. For example, the compound Sorbothane TM available from Sorbothane, Inc., 2144 State Route 59, P.O. Box 178, Kent, Oh. 44240 is a viscoelastic polymer which has a very low durometer reading of 30–70 Shore 00. Sorbothane TM is generally described in U.S. Pat. No. 4,346,205. Other polyurethane compounds may be suitable. For example, Mearthane Products Corp., 70 Glen Road, Cranston, R.I, 02920 manufactures a viscoelastic polymer known as Mearthane TM which is similar to Sorbothane TM.

Figure 4:
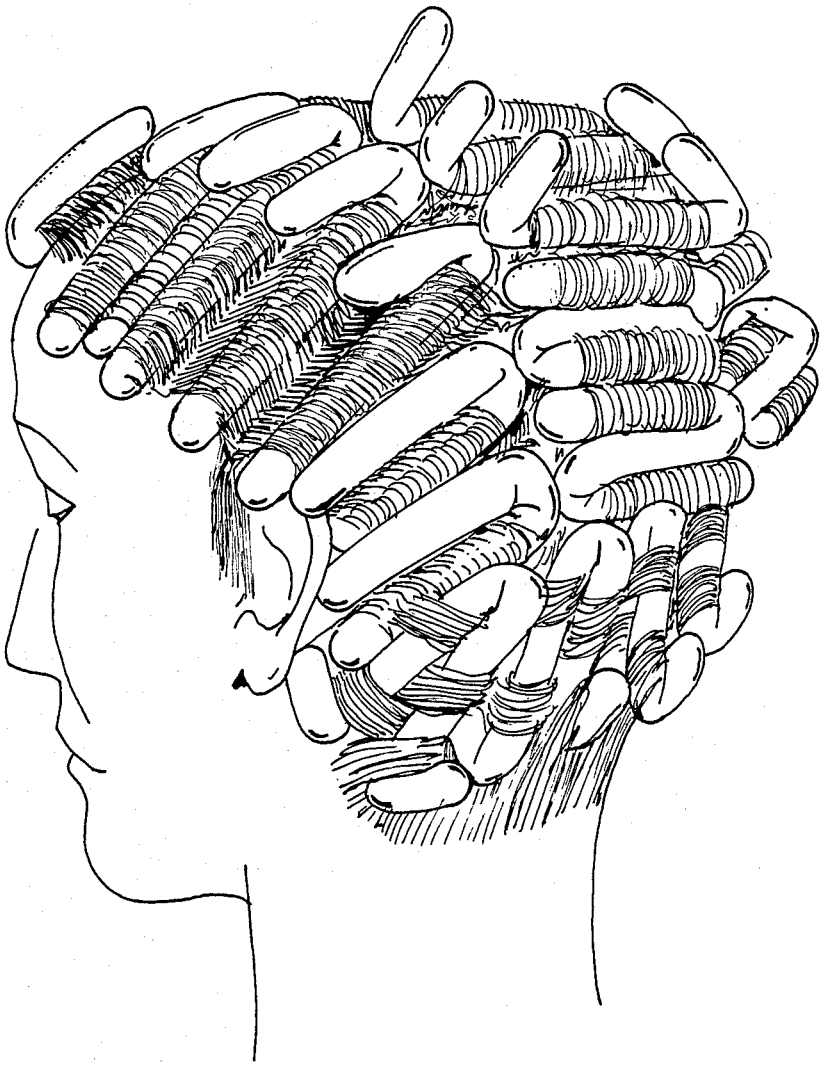
FIG. 4 is a sketch showing several possible configurations into which the flexible hair curlers may be bent in actual use.

The curler is intended to be used with an external heat source such as that described in a copending application entitled Hairsetter For Flexible Hair Curlers filed concurrently herewith, having Ser. No. 671,343 and assigned to the assignee hereof. After the curlers are heated in such an external heat source they may be used to curl hair in the conventional manner, some examples of which are shown in FIG. 4.

Figure 5A:
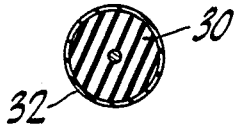
FIGS. 5A and 5B are end and side cross-sections of an alternate embodiment of the invention.
Figure 5B:
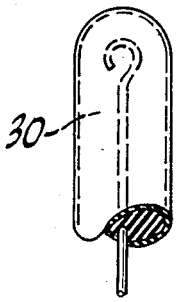

It will be understood that, while the preferred embodiment of the invention comprises essentially two parts -- a core wire and a heatable polyurethane based composition -- the advantages of the invention are achievable by other embodiments. Thus, as shown in FIGS. 5A and 5B the central core wire could be embedded in a conventional open-celled cylindrical foam shell 30 which could be impregnated with a heatable gel or other composition and the entire curler could then be encased in, for example, a silicone rubber tube 32 or other soft, pliable liquid-impervious casing material. The gel could alternatively be injection molded with the foam and covered with a plastisol or other coating by spraying or dipping.

It will be understood by those skilled in the art that numerous other improvements and modifications may be made to the preferred embodiment of the invention disclosed herein without departing from the spirit and scope hereof. For example, the surface of any of the embodiments disclosed herein may be coated with flocking material to enhance the soft feel of the curlers and to assist in gripping the hair. The principles of this invention could also be embodied in hair curlers of various cross-sectional shapes (elliptical, polygonal, etc.) and various overall shapes (toroidal, elliptical, etc.). For example, a hair curler could incorporate a spiral groove or ridge along its length or varying diameters along its length.

What is claimed is:

1. In a method of curling hair with a flexible hair curler having a dry, non-absorbent external surface, said flexible hair curler comprising a non-porous body of pliable, flexible material molded about an axial core, said curler capable of being bent into a plurality of positions and retaining any such bent position, said curler further capable of retaining heat for a predetermined time, the improvement comprising the steps of:

heating said flexible hair curler by external heating means prior to use; and then curling hair onto said flexible hair curler while the latter is dry.

2. In a method of curling hair with a flexible hair curler having a dry, non-absorbent external surface, said flexible hair curler comprising a non-porous body of pliable, flexible material capable of being bent into a plurality of positions and retaining any such bent position, said curler further capable of retaining heat for a predetermined time, the method comprising curling hair onto said flexible hair curler and bending the latter into a selected one of said positions in order to thereby retain the hair curled about said flexible hair curler, the improvement comprising the step of:

heating said flexible hair curler by external heating means prior to use.

* * * * *